US007360726B2

(12) United States Patent
Nilsson et al.

(10) Patent No.: US 7,360,726 B2
(45) Date of Patent: Apr. 22, 2008

(54) METHOD AND CONTROL SYSTEM FOR STARTING CRUSHING IN A GYRATORY CRUSHER

(75) Inventors: Kent Nilsson, Mamlö (SE); Mattias Nilsson, Sjöbo (SE)

(73) Assignee: Sandvik Intellectual Property AB, Sandviken (SE)

( * ) Notice: Subject to any disclaimer, the term of this patent is extended or adjusted under 35 U.S.C. 154(b) by 88 days.

(21) Appl. No.: 10/544,572

(22) PCT Filed: Feb. 6, 2004

(86) PCT No.: PCT/SE2004/000152

§ 371 (c)(1),
(2), (4) Date: Jan. 9, 2006

(87) PCT Pub. No.: WO2004/069415

PCT Pub. Date: Aug. 19, 2004

(65) Prior Publication Data

US 2006/0231650 A1 Oct. 19, 2006

(30) Foreign Application Priority Data

Feb. 10, 2003 (SE) ..... 0300328

(51) Int. Cl.
*B02C 25/00* (2006.01)

(52) U.S. Cl. ..... 241/30; 241/37; 241/207

(58) Field of Classification Search ..... 241/37, 241/207–216, 30
See application file for complete search history.

(56) References Cited

U.S. PATENT DOCUMENTS 4,856,716 A * 8/1989 Burstedt ..... 241/30
5,927,623 A * 7/1999 Ferguson et al. ..... 241/36

FOREIGN PATENT DOCUMENTS

SE 476526 8/1992
WO 93/14870 8/1993

* cited by examiner

*Primary Examiner*—Mark Rosenbaum
(74) *Attorney, Agent, or Firm*—Drinker Biddle & Reath LLP

(57) ABSTRACT

In a method for starting a crushing operation in a gyratory crusher in which rocks are passed through a crushing gap to be crushed, the following steps are carried out: (a) a driving device is started which causes a crushing head to execute a gyratory pendulum movement, and a first width of the crushing gap is set, (b) a supply of material to the gap is commenced, (c) the resulting load on the crusher is measured, (d) the width of the gap is adjusted so that the load approaches a desired value, (e) a measure which is representative of the width of the gap after adjustment, is read, and (f) such read measure is utilized for calculation of a gap width for use as a first width of the gap in carrying out step (a) of the next start-up of a crushing operation.

9 Claims, 5 Drawing Sheets

METHOD AND CONTROL SYSTEM FOR STARTING CRUSHING IN A GYRATORY CRUSHER

TECHNICAL FIELD OF THE INVENTION

The present invention relates to a method for starting crushing in a gyratory crusher, which comprises a crushing head provided with a first crushing shell, which head is fastened on a shaft, and a second crushing shell together with the first crushing shell defining a crushing gap, the width of which is adjustable, the gap being arranged to receive material which is to be crushed and a driving device being arranged to bring the crushing head to execute a gyratory pendulum movement.

The present invention also relates to a control system for starting-up crushing in a gyratory crusher, which is of the above-mentioned kind.

TECHNICAL BACKGROUND

A gyratory crusher of the above-mentioned type may be utilized in order to crush hard material, such as pieces of rock material. An example of such a crusher is disclosed in WO 93/14870. Upon starting-up crushing in a gyratory crusher, the motor that drives the shaft having the crushing head mounted thereon is first started and then supply of material is commenced in a gap between an inner and an outer shell. It has turned out that gyratory crushers occasionally get stuck, i.e., the inner shell is jammed against the outer shell when the material initially reaches the gap between the inner and the outer shell. For this reason, a safety factor is utilized which means that the gap width between the inner and the outer shell is set to a larger value in the start than what is expected to be suitable for continuous operation at the material supply in question. When the crushing has become stable, the gap is decreased to the desired value.

The above-described method for starting a crusher may to a certain degree decrease the risk of mechanical damage on the crusher during the starting-up but entails that it takes a long time to reach optimal crushing conditions in the crusher.

SUMMARY OF THE INVENTION

An object of the present invention is to provide a method for starting a gyratory crusher, which method is efficient and ensures a low mechanical load on the crusher.

This object is attained by a method for starting crushing in a gyratory crusher, which is of the kind mentioned by way of introduction, which method is characterized by the following steps a) that the driving device is started and brings the crushing head to execute a gyratory pendulum movement and that a first gap width is set, b) that a supply of material in the gap is commenced, c) that the resulting load on the crusher is measured, d) that the gap width is adjusted so that the load will approach a desired value, e) that a measure which is representative of the gap width after adjustment is read, and f) that the read measure which is representative of the gap width after adjustment is utilized for calculation of a gap width for use as first gap width in carrying out step a) upon a next-coming starting-up of a crushing course.

A gyratory crusher is stopped and started usually relatively frequently by virtue of, for instance mechanical disturbances in the supply, change of material which is crushed, change of crushing parameters, operators' breaks, etc. Thus, it is of large importance that the starting-up can take place quickly, that the crusher quickly reaches high efficiency and that mechanical damages are avoided. A large advantage of the method according to the invention is that the crushing can start very fast without exaggeratedly high loads initially and with high rate of production already from the beginning. The initial stage of the crushing, during which a bed of material is built up in the gap, becomes short and a normal crushing is provided at a very small loss of time. Another advantage of the same method is the first gap width is changed depending on how the supplied material behaves in the crusher. Thus, an adaptation is carried out of the conditions upon starting-up to variations in the properties of the supplied material over time.

Preferably step b) also comprises that a countdown of a predetermined time is started when the supply of material in the gap is commenced and step d) also comprises that a check if an adjustment has taken place within said predetermined time is carried out, step f) being carried out only if said adjustment has taken place within said predetermined time. An advantage of this is that a change of the first width at a next-coming starting-up only is made if it is needed. An adjustment of the gap width that is carried out far after the supply of material having been commenced, i.e., after the predetermined time, has probably other reasons, as, e.g. , problem with the supply, than the proper starting-up course. By the fact that the countdown of the time is commenced in connection with start of supply of material to the gap, it is guaranteed that the countdown is related to the starting-up of the crushing. The check in step d) means that adjustments that are not concerned with the proper starting-up do not affect the first width that is calculated at a next-coming starting-up.

According to an even more preferred embodiment, said predetermined time is 3-30 s. It has turned out that it takes at least approx. 3 s before a starting-up-related adjustment is expected to have taken place. After approx. 30 s, the possible adjustments taking place are no longer related to the starting-up but rather the variations that arise in the continuous operation of the crusher.

According to a preferred embodiment, if a plurality of adjustments have taken place within said predetermined time, the measure which is representative of the gap width after the first adjustment is read in step e). An advantage of this is that, if a plurality of adjustments are carried out during the predetermined time, the first adjustment is utilized, which is the adjustment that is most relevant for calculation of a first width for use in a next-coming crushing course.

According to a preferred embodiment, if adjustment of the gap width according to step d) has taken place not until after said predetermined time, the same first gap width as upon the current starting-up is selected as gap width for use as first gap width in carrying out step a) upon a next-coming starting-up. If an adjustment of the gap width has taken place not until after the predetermined time, or possibly not at all, this adjustment is not assignable to the starting-up course. In such a case, the first width was a very suitable first width since no adjustment of the gap width was required during the starting-up course. It is then suitable to use the same first width one more time upon a next-coming starting-up.

Preferably, step f) comprises that a ratio between the measure which is representative of the gap width after adjustment and a width which is intended to be used during continuous operation of the crusher is calculated, and that the first gap width in carrying out step a) upon a next-coming starting-up is calculated based on this ratio. An advantage of this is that the ratio is simple to compute and directly can be utilized for calculating a suitable first width for a next-coming starting-up. Another advantage is that the ratio between the gap width after adjustment and the gap width during continuous operation is dimensionless. Thereby, said ratio may be used for computing a suitable first width for a certain desired continuous gap width based on ratios of previous starting-ups, which not necessarily have taken place at the same continuous gap width.

According to an even more preferred embodiment, a mean value is calculated of the ratios between the measure representative of the gap width after adjustment and the width intended for use during continuous operation of the crusher which have been calculated upon a plurality of starting-ups, the same mean value being utilized for calculation of a first width in carrying out step a) upon a next-coming starting-up. An advantage of this is that mean values impart a smoothing of historical ratios, for instance from the five latest starting-ups. Thereby, the influence from an occasional starting-up where said ratio has become unreasonable decreases, for instance by virtue of an unusually hard stone block. Thus, the mean value will ensure that the first width is adapted concurrently with more long-term variations in the properties of the material without being influenced too much of temporary disturbances.

According to an even more preferred embodiment, the ratios that have been calculated upon the 3-10 latest starting-ups are utilized for calculation of said mean value. To use historical values from fewer than 3 starting-ups have turned out to give an adaptation of the first width that is fairly fluctuant and is heavily influenced by occasional disturbances. More than 10 starting-ups means that the adaptation of the first width on variations in the material becomes very slow.

An additional object of the present invention is to provide a control system for starting-up crushing in a gyratory crusher, which control system entails a high efficiency in the crushing and ensures a low mechanical load on the crusher.

This object is attained by a control system for starting-up crushing in a gyratory crusher, which is of the kind mentioned by way of introduction, which control system is characterized by means for start of the driving device in order to bring the crushing head to execute a gyratory pendulum movement, means for adjusting a first gap width, means for receiving measuring signals concerning the load on the crusher resulting from the supplied material, means for such an adjustment of the gap width that the load approaches a desired value, means for reading out a measure which is representative of the gap width after adjustment, and a device in order to, by means of said measure, calculate a gap width for use as first gap width in carrying out a next-coming starting-up of a crushing course. An advantage of the control system according to the invention is that the crushing can start very fast without exaggeratedly high loads initially and with a high rate of production already from the beginning.

According to a preferred embodiment, said means for receiving measuring signals also comprises a clock for countdown of a predetermined time from a juncture when supply of material has been commenced, the device, in order to calculate, by means of said measure, a gap width for use as first gap width in carrying out a next-coming starting-up of a crushing course, carrying out said calculation only if said adjustment has taken place within the predetermined time.

BRIEF DESCRIPTION OF THE DRAWINGS

The invention will henceforth be described by means of embodiment examples and with reference to the appended drawings.

DESCRIPTION OF PREFERRED EMBODIMENTS

Figure 1:
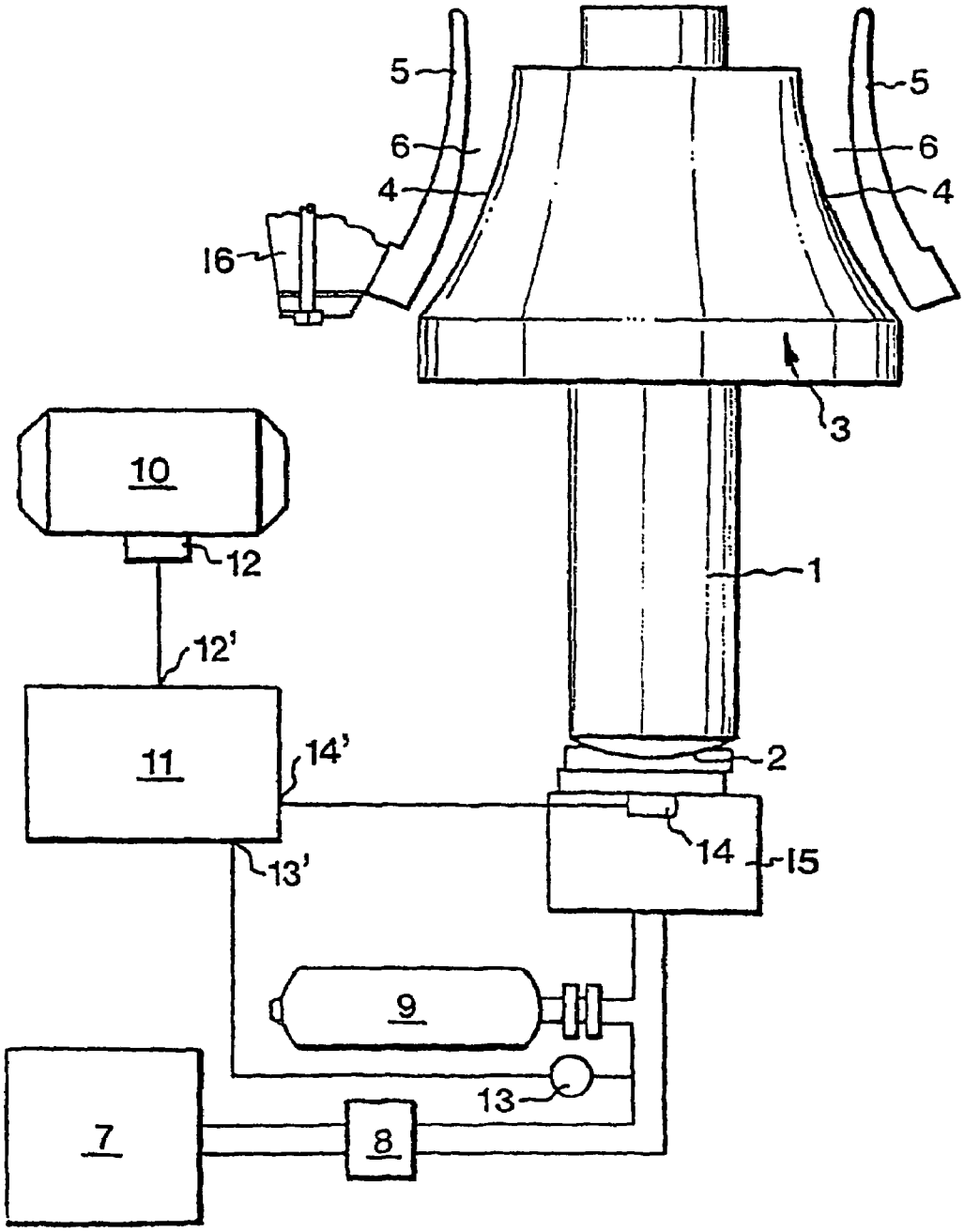
FIG. 1 schematically shows a gyratory crusher having associated driving, adjusting and control devices.

In FIG. 1, a gyratory crusher is shown schematically, which has a shaft 1.

At the lower end 2 thereof, the shaft 1 is eccentrically mounted. At the upper end thereof, the shaft 1 carries a crushing head 3. A first, inner, crushing shell 4 is mounted on the outside of the crushing head 3. In a machine frame 16, a second, outer, crushing shell 5 has been mounted in such a way that it surrounds the inner crushing shell 4. Between the inner crushing shell 4 and the outer crushing shell 5, a crushing gap 6 is formed, which in axial section, as is shown in FIG. 1, has a decreasing width in the direction downwards. The shaft 1, and thereby the crushing head 3 and the inner crushing shell 4, is vertically adjustable by means of a hydraulic adjusting device, which comprises a tank 7 for hydraulic fluid, a pump 8, a gas-filled container 9 and a hydraulic piston 15. Furthermore, a motor 10 is connected to the crusher, which motor during operation is arranged to bring the shaft 1, and thereby the crushing head 3, to execute a gyratory movement, i.e., a movement during which the two crushing shells 4,5 approach each other along a rotary generatrix and distance from each other at a diametrically opposite generatrix.

In operation, the crusher is controlled by a control device 11, which, via an input 12', receives input signals from a transducer 12 arranged at the motor 10, which transducer measures the load on the motor 10, via an input 13' receives input signals from a pressure transducer 13, which measures the pressure in the hydraulic fluid in the adjusting device 7, 8, 9, 15 and via an input 14' receives signals from a level transducer 14, which measures the position of the shaft 1 in the vertical direction in relation to the machine frame 16. The control device 11 comprises, among other things, a data processor and controls, on the basis of received input signals, among other things, the hydraulic fluid pressure in the adjusting device.

As used in the present application, "load" relates to the stress that the crusher is exposed to on a certain occasion. The load may, for instance, be expressed in the form of the hydraulic fluid pressure measured by the pressure transducer 13 in relation to a desired value of the same pressure. The load may also be expressed as the motor power measured by the transducer 12 in relation to a desired value of the same power. The control device 11 will control according to the load, hydraulic fluid pressure/motor power, which is highest in relation to the desired value thereof.

When the crusher is to be started, a calibration is first carried out without feeding of material. The motor 10 is started and brings the crushing head 3 to execute a gyratory pendulum movement. Then, the pump 8 increases the hydraulic fluid pressure so that the shaft 1, and thereby the inner shell 4, is raised until the inner crushing shell 4 comes to abutment against the outer crushing shell 5. When the inner shell 4 contacts the outer shell 5, a pressure increase arises in the hydraulic fluid, which is recorded by the pressure transducer 13. The inner shell 4 is lowered somewhat in order to avoid that it "sticks" against the outer shell 5, and then the motor 10 is stopped and a so-called A measure, which is the vertical distance from a fixed point on the shaft 1 to a fixed point on the machine frame 16, is measured manually and fed into the control device 11 to represent the corresponding signal from the level transducer 14. Next, the motor 10 is restarted and the pump 8 then pumps hydraulic fluid to the tank 7 until the shaft 1 reaches the lowermost position thereof. The corresponding signal from the level transducer 14 for said lower position is then read by the control device 11. Knowing the gap angle between the inner crushing shell 4 and the outer crushing shell 5, the width of the gap 6 may be calculated at any position of the shaft 1 as measured by the level transducer 14.

When the calibration is finished, a first width of the gap 6 is set and supply of material to the gap 6 of the crusher is commenced. The control device 11 is arranged to automatically set a suitable first width according to a method that will be described more in detail below.

Figure 2:
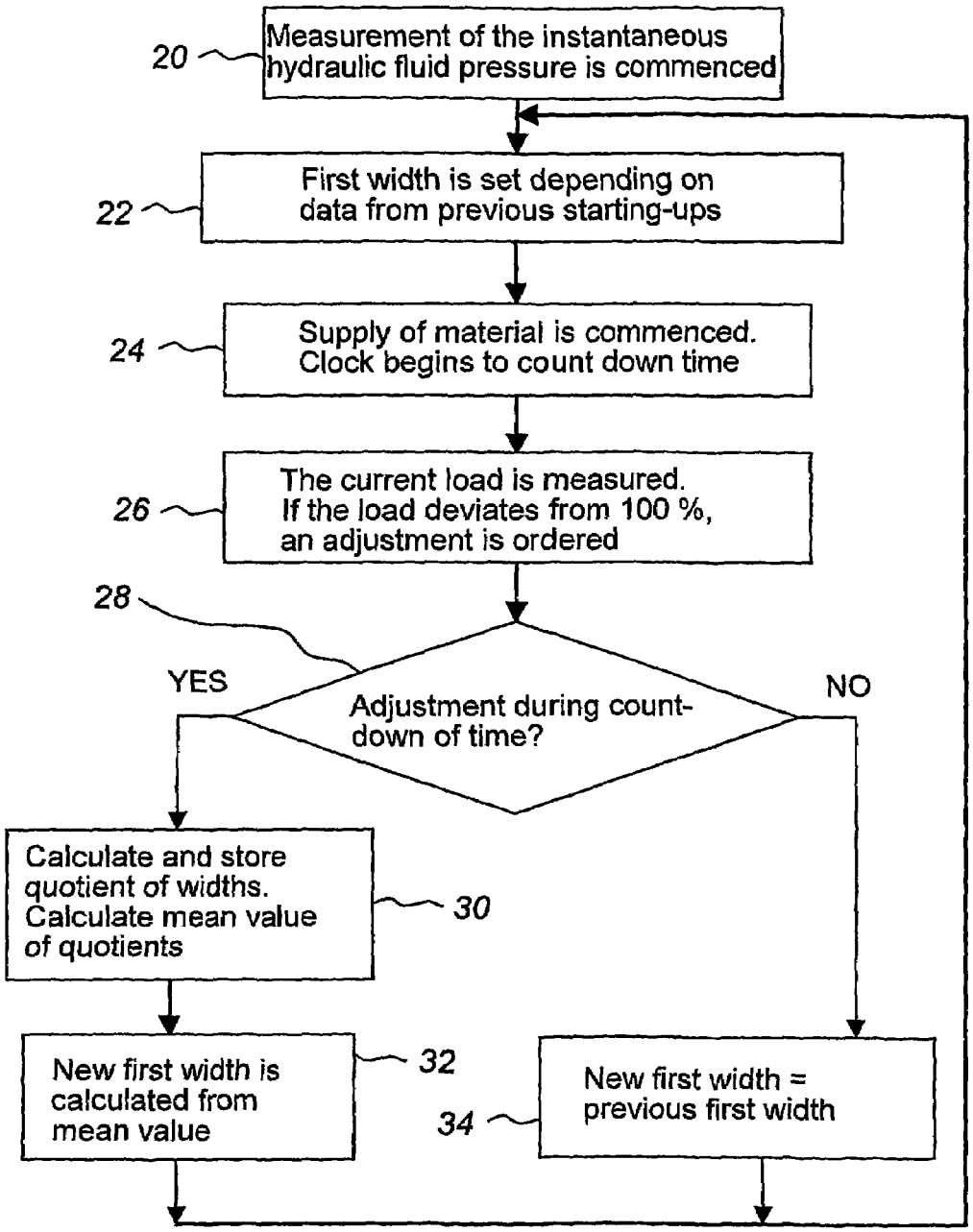
FIG. 2 shows a flow chart for controlling starting-up of crushing.

FIG. 2 schematically shows the method for automatically adjusting a suitable first width of the gap 6 at the start of the crusher. The example shown in FIG. 2, assumes that it is the hydraulic fluid pressure that is controlling as regards the load, but it may, as is mentioned above, alternatively be the power of the motor or some other parameter. Furthermore, the example is based on a certain fix gap width being desired during continuous operation in order to obtain a crushed product having a certain size distribution and said gap width at the material supply in question corresponds to 100% load during continuous operation.

It has turned out that the supplied material may behave in three different ways when the supply is commenced:

A. The material may tend to, when supply is commenced, stop up the gap 6 with the result that the inner shell 4 and the outer shell 5 lock against each other with risk of mechanical damage.
B. The material behaves the same initially as during continuous operation.
C. The material may tend to, when supply is commenced, run through the crusher without forming any bed of crushed material.

In case A, it is suitable to start with a greater width of the gap 6 than the width that is intended to be used during the continuous operation. In case B, the width of the gap 6 may at start be the same as during continuous operation. In case C, the width of the gap 6 should at start be smaller than the width that is intended to be used during continuous operation in order to build up a bed of material quickly in the gap 6. Thus, the size on the first width of the gap 6 depends on how the material behaves initially when supply is commenced. Which type of behavior a certain material has is difficult to determine beforehand and the behavior may also be changed in course of time by virtue of the character of the material as regards hardness, size, moisture content, size distribution, etc., is changed.

In the step 20 shown in FIG. 2, measurement is commenced of the instantaneous hydraulic fluid pressure in the adjusting device 7, 8, 9, 15 by means of the pressure transducer 13. The measurement of the instantaneous hydraulic fluid pressure started in step 20 continues as long as the crusher is in operation. The signal from the pressure transducer 13 is received by the control device 11. In step 22, a first width of the gap 6 is set depending on data stored in the control device 11 from previous starting-ups of the crusher. The calculation of the first gap width is described in closer detail below. In step 24, the supply of material to the gap 6 is commenced. When a detectable hydraulic fluid pressure increase, e.g. a pressure increase of 0.5 MPa, which indicates that material has commenced to be machined in the gap 6, is recorded, a clock begins to count down time from a predetermined time, for instance 10 s. In step 26, the control device 11 senses the current load, i.e., in this case the current hydraulic fluid pressure. If the load deviates from 100%, an adjustment of the hydraulic fluid pressure is ordered, i.e., the hydraulic fluid pressure is increased in order to decrease the gap width, and thereby increase the load, or is decreased in order to increase the gap width, and thereby decrease the load. In step 28, it is determined if said adjustment of the hydraulic fluid pressure was made during the predetermined time.

If the adjustment was made during the predetermined time, a measure of the width of the gap 6 is read in step 30 after the adjustment and then a ratio in the form of a quotient between the width of the gap 6 after the adjustment and the width of the gap 6 during continuous operation is calculated. The quotient is stored in the control device 11. In step 30, also a mean value is calculated of the latest quotient between the gap after adjustment and the gap during continuous operation and the corresponding quotients which have been calculated upon the preceding starting-ups of the crusher, for instance the four preceding the starting-ups of the crusher. If in step 28 it has been established that an adjustment has been carried out during the time chosen beforehand, a new first width of the gap 6 is calculated in step 32 as said mean value multiplied by the intended width of the gap 6 during continuous operation.

If in step 28 it has established that no adjustment has been carried out during the predetermined time, the new first width of the gap 6 is instead selected in step 34 to the same value as in the preceding starting-up, i.e., the first width that was utilized in step 22. In step 34, also a quotient between the first width of the gap 6 and the intended width of the gap 6 during continuous operation is calculated and stored. This quotient is not utilized in step 34 but may be used in step 30 upon a next-coming starting-up.

The new first gap width, which has been determined in step 32 or 34, is then utilized in step 22 in order to set a suitable first width of the gap 6 upon the next-coming starting-up.

The occasions when the pump 8 should be taken into operation, "pump", and how long it should pump hydraulic fluid to or from the piston 15, is thus controlled by the control device 11. The pumping is carried out during a certain space of time, the length of which is proportional in steps to the difference between the current load level and the desired value, i.e., if the current load level is within a certain interval at a certain distance from the desired value, pumping is carried out during a certain time, while if the current load level is in an interval that is closer to the desired value, the pumping is carried out during a shorter space of time.

Figure 3:
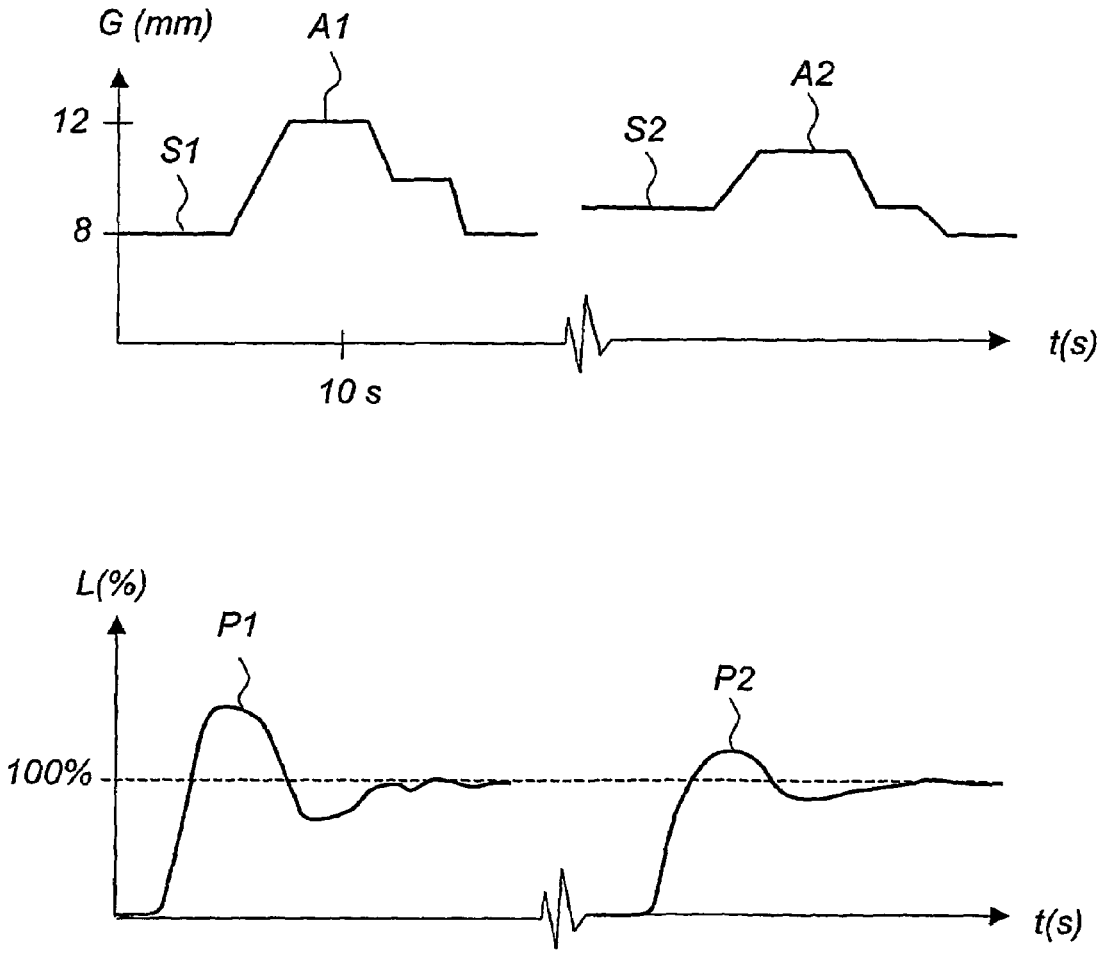
FIG. 3 shows a first example of how the method according to the invention is utilized for calculation of a first gap width.

FIG. 3 shows a first example of how the gap width after adjustment during a starting-up is utilized in order to choose a suitable first width for the next-coming starting-up. The upper chart relates to the width G (in mm) of the gap 6 as a function of time t and the lower chart relates to the corresponding load L (in %) as a function of time.

In the example, a fixed gap width of 8 mm is intended to be used during continuous operation (, a constant-operation reference width). Upon a first start, there is no knowledge about the material and a first width S1 of the gap 6 is therefore also set to 8 mm. In connection with the start, the load increases, i.e., the hydraulic fluid pressure, almost immediately to considerably above 100%, as is seen in the graph P1, by virtue of the material tending to stop up the gap 6. Countdown of the predetermined time is commenced when a pressure increase of 0.5 MPa, corresponding to approx. 10% load, is detected. The control device 11 records, in the above mentioned step 26, the high load and instructs, after a delay of approximately 2 s, the pump 8 to decrease the hydraulic fluid pressure, and thereby increase the gap width. During this first adjustment, the width of the gap 6 is increased to an adjusted width A1 of 12 mm. The crushing is eventually stabilized, and the gap may gradually be lowered to the desired gap of 8 mm. In step 28 of the above-mentioned sequence, it is determined that said adjustment of the gap width took place within the predetermined time, 10 s, and therefore should be counted as assignable to the starting-up. The quotient between adjusted width A1 and desired gap width, i.e., 8 mm, is calculated in step 30 to 12 mm divided by 8 mm=1.5. In step 30, a mean value is also calculated of said quotient and four previously calculated quotients. Since the example start out from a first start, the four previous quotients are set to 1.0. Thereby, the mean value becomes: (1.0+1.0+1.0+1.0+1.5)/5=1.1. At the next-coming starting-up, a new first width S2 is calculated in step 32 as the desired width of 8 mm in continuous operation multiplied by the mean value 1.1=8.8 mm. A first width S2 of 8.8 mm is thereby set in step 22 the next time crushing is to be started. Material is supplied and as is seen in the hydraulic pressure graph P2, the initial load rises to only somewhat above 100%. An adjustment of the gap width to a width A2 of 11 mm is however ordered by the control device 11 within the predetermined time of 10 s. Thus, a new quotient is calculated as adjusted width A2 of 11 mm divided by desired width of 8 mm=1.375. The mean value of this and the four previous quotients becomes (1.0+1.0+1.0+1.5+1.375)/5=1.175. Thus, on the next-coming starting-up, a new first width S3, not shown, is used, which has been calculated as 8 mm multiplied by 1.175=9.4 mm. After some additional starting-ups, the first width will be such that the load quickly reaches 100% and is stabilized on this value without substantially exceeding the value.

Figure 4:
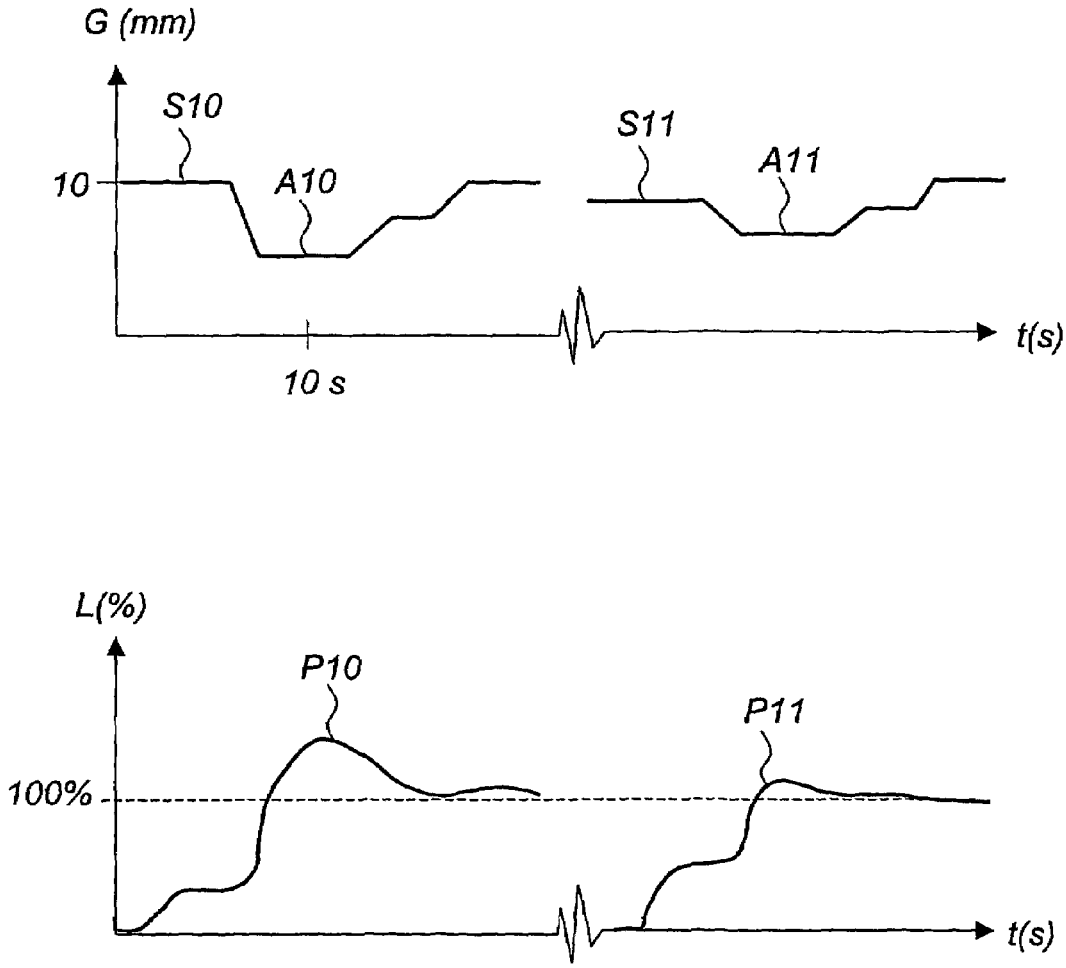
FIG. 4 shows a second example of how the method according to the invention is utilized for calculation of a first gap width.

FIG. 4 shows a second example of how the gap width after adjustment during a starting-up is utilized in order to choose a suitable first width for the next-coming starting-up. In this example, a fixed gap width of 10 mm is used during continuous operation. The first width of the gap 6 has, during a plurality of previous starting-ups, been stable around 10 mm. Since no adjustment has been required within the predetermined time during the same preceding starting-ups, the same first gap width has been selected in a preceding step 34, i.e., a first width S10 of 10 mm. The quotients which in step 34 have been stored in the control device 11 for possible future use are all 10 mm/10 mm=1.0.

However, now a new material, the properties of which the operator does not know, is to be crushed. In connection with the starting-up of crushing with the new material, the load, i.e., the hydraulic fluid pressure, does initially not reach up to more than approx. 25%, as is seen in the graph P10, by virtue of the new material tending to run through the crusher. The control device 11 records, in the above mentioned step 26, the low load and instructs after a delay of approximately 3 s the pump 8 to increase the hydraulic fluid pressure and thereby decrease the gap width. During this first adjustment, the width of the gap 6 is decreased to an adjusted width A10 of 5 mm. Thereby, the load rises to above 100% load, the control device 11 again increasing the gap width. The crushing is eventually stabilized and the gap width may gradually be increased to the width of 10 mm desired for continuous operation. In step 28 of the above-mentioned sequence, it is determined that said adjustment of the gap width took place within the predetermined time, 10 s, and therefore should be counted as assignable to the starting-up. The quotient between adjusted width A10 and desired gap width during continuous operation is thus calculated in step 30 to 5 mm divided by 10 mm=0.5. In step 30, a mean value is calculated of the same quotient and the four previously calculated quotients which according to the above all were 1,0. Thereby, the mean value becomes: (1.0+1.0+1.0+1.0+0.5)/5=0.9. At the next-coming starting-up, a new first width S11 is calculated in step 32 as the desired gap of 10 mm multiplied by the mean value 0.9=9 mm. Material is supplied and as is seen in the hydraulic fluid pressure graph P11, the initial load becomes approx. 50%. An adjustment of the gap width to a width A11 of 6 mm is however ordered by the control device 11 within the prescribed time of 10 s. Thus, a new quotient is calculated in step 30 as 6 mm divided by 10 mm=0.6. The mean value of the same and previous quotients becomes (1.0+1.0+1.0+0.5+0.6)/5=0.82. Upon the next-coming starting-up, a new first width S12, not shown, is calculated as 10 mm multiplied by 0.82=8.2 mm. After some additional starting-ups, the first width will be such that the load quickly reaches 100% and is stabilized on the same value.

As is clear from the above, the method according to the invention ensures that starting-up of the crusher goes quickly without needless mechanical load and without loosing precious production time thanks to the crusher quickly reaching a load of 100%. The method according to the invention also ensures that the first width automatically is adjusted when characteristics of the supplied material, such as hardness, size, and quantity, are changed.

In the above-described examples, a fixed width of the gap 6 of 8 and 10 mm, respectively, during continuous operation is described, which during the supply in question corresponds to 100% load. As is realized by a person skilled in the art, this control point may be difficult to keep during continuous operation with the variations in supply of material which inevitably arise. Therefore, the operator may, for instance, choose to let the control device 11 during continuous operation vary the gap width somewhat within certain limits in order to reach 100% load, i. e., control towards a fixed load, alternatively keep the gap width fixed at, e.g., 10 mm and accept that the load differs from 100% load, i.e., control towards a fixed gap width.

In the case with control towards a fixed gap width, e.g., 10 mm, it is shortly during the starting-up occasionally necessary to utilize a gap width that is smaller than the fixed gap width in order to build up a bed of crushed material in the gap 6. Therefore, upon starting-up, the course will be similar to the course described in FIG. 4. For instance, the control device 11 may, if the load within, e.g., 5 s has not reached a minimum load, e. g. 70% load, order a reduction of the gap width from the fixed gap width in order to build up a bed of material in the gap 6. When the bed has been built up, the fixed gap width is automatically returned to. In the method that has been described above, in the control device 11 data is stored about which adjustment that was made in order to, upon the next-coming starting-up, use a smaller first width of the gap 6.

During control towards a fixed load, normally 100%, the gap width varies somewhat also during stable operation. The gap width that should be utilized as the continuous gap width and thereby should be multiplied by said mean value in order to obtain a first width in carrying out the next-coming starting-up of crushing, is suitably the gap width which prevailed immediately before the supply of material, and thereby the crushing, was stopped. This gap width, which has been prevailing immediately before the stop, is probably the one which best represents the material conditions which will prevail during the next-coming starting-up and the operation following closest thereafter.

Irrespective of principle, such as control towards fixed load, control towards fixed gap or a combination of said control principles, which, for instance, is disclosed in WO 93/14870, which is used in stable operation, the invention according to the above may be utilized upon starting-up of the crushing.

Figure 5:
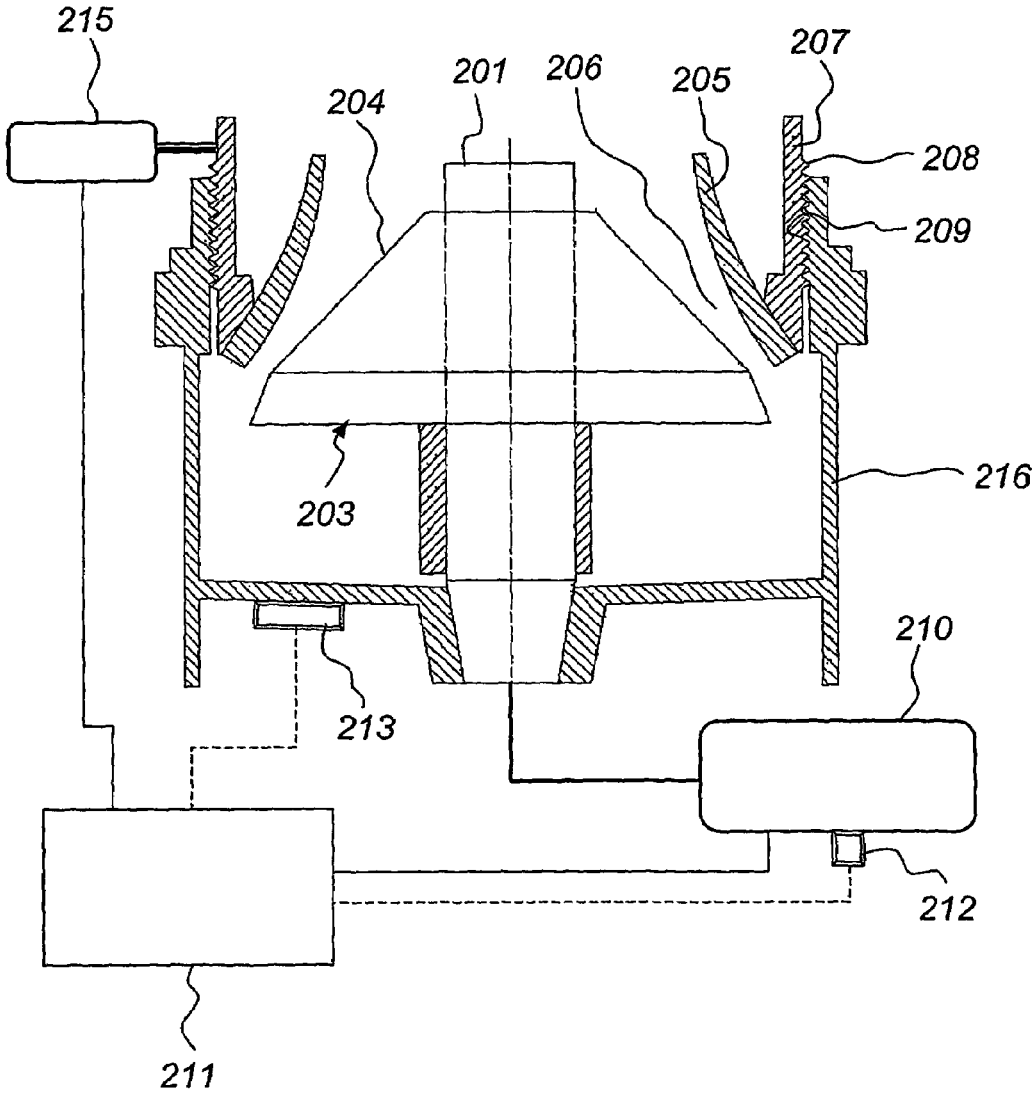
FIG. 5 shows a gyratory crusher having mechanical adjusting of the gap width.

FIG. 5 schematically shows a gyratory crusher that is of another type than the crusher shown in FIG. 1. The crusher shown in FIG. 5 has a shaft 201, which carries a crushing head 203 having an inner crushing shell 204 mounted thereon. Between the inner shell 204 and an outer crushing shell 205, a crushing gap 206 is formed. The outer crushing shell 205 is attached to a case 207 having a stepped thread 208. The thread 208 mates with a corresponding thread 209 in a crusher frame 216. Furthermore, a motor 210 is connected to the crusher, which is arranged to bring the shaft 201, and thereby the crushing head 203, to execute a gyratory movement during the operation. When the case 207 is turned around the symmetry axis thereof by an adjustment motor 215, the outer crushing shell 205 will be moved vertically, the width of the gap 206 being changed. On this type of gyratory crusher, accordingly the case 207, the threads 208,209 as well as the adjustment motor 215 constitute an adjusting device for adjusting of the width of the gap 206. In a crusher of this type, the load during the starting-up may be measured by means of a transducer 212, which measures the instantaneous power being generated by the motor 210 and which transmits a signal concerning the same power to a control device 211. Upon starting-up, a first width of the gap 206 is set and material begins to be supplied to the gap 206. If the power measured by the transducer 212 upon the starting-up deviates from the desired value of power, the control device 211 instructs the adjustment motor 215 to turn the case 207, and thereby increase or decrease the width of the gap 206 with the purpose of getting the power to approach the desired value. The width that the gap 206 gets after the adjustment is utilized according to the same principle as has been described above in order to determine a suitable first gap width for a next-coming starting-up.

An alternative method to measure the load, which method works both in crushes having hydraulic adjusting devices and crushes of the type which is shown in FIG. 5, is to measure a mechanical stress or tension in the proper crusher. As is seen in FIG. 5, a strain gauge 213 has been applied on the crusher frame 216. The strain gauge 213, which measures the instantaneous strain in that part of the frame 216 to which it is attached, is suitably positioned on a location on the frame 216 which gives a representative picture of the mechanical load on the crusher. The strain measured during the starting-up is compared with a desired value and possibly the adjustment motor 215 is instructed to adjust the width of the gap 206. The width of the gap 206 after adjustment is utilized according to the above description for determination of a suitable first width for a next-coming starting-up.

It will be appreciated that a number of modifications of the above-described embodiments are feasible within the scope of the invention, such as it is defined by the appended claims.

According to the embodiment examples above, a new first width of the gap (6) is calculated when an adjustment of the width has taken place within a predetermined time. However, it is also possible, but less preferred, to spare a predetermined time and always await a first adjustment and utilize this adjustment for calculation of a new first gap width. However, a disadvantage is that in certain cases, an adjustment that is not assignable to the starting-up but to far later events may affect the calculation of a new first gap width. Thus, it is preferred to utilize an adjustment that has taken place within a predetermined time, the length of which is relevant in relation to the starting-up course.

In the examples shown in FIGS. 3 and 4, the entire first adjustment, to the width A1 and A10, respectively, has time to take place within the predetermined time. However, situations may arise when the predetermined time runs out in the middle of an adjustment in progress. In such a case, it may be proceeded in various ways. One way is, if the adjustment is in progress when the predetermined time runs out, to wait until the adjustment is completed and read a measure of the gap width when the adjustment is completed and use the same measure as representative of the gap width after adjustment. An alternative way is to read a measure of the gap width only in the very moment when the predetermined time runs out and use the same measure as representative of the gap width after adjustment. A third alternative is to entirely disregard such adjustments that not had time to become completed within the predetermined time. Which alternative that is suitable is selected in correlation with the predetermined time in question.

According to the above, the width of the gap 6 between the inner and the outer shell 4,5 is utilized for calculation of a quotient. It is also possible to utilize a measure which is representative of the same width. There are several measures that may represent the width of the gap 6. For instance, the levels that are measured by the level transducer 14 after first adjustment and during continuous operation, respectively may be directly utilized.

It is understood that the width of the crushing gap 6,206 can be adjusted in different ways and that the above-described ways, while referring to FIG. 1 and FIG. 5, are non-limiting examples.

The starting order of the driving device and adjusting of first gap width is not decisive for the invention. Thus, the first gap width may be set and the driving device then be started or the opposite, i.e., the driving device is started first and the gap width is then set.

It is suitable to utilize certain limits for how much the adjusted width, e. g. A1, of the gap 6 is allowed to deviate from the width that is intended be used during continuous operation. It has turned out to be suitable to let the adjusted gap, e. g. A1, be no more than 2.5 times the width during continuous operation and no less than 0.5 times the width during continuous operation for avoiding too large and too small, respectively, gap widths.

Above is described how a mean value is calculated of the five latest quotients between the gap width that is obtained after adjustment upon the respective starting-up and desired gap width during continuous operation. Of course, it is possible to use more than the five latest quotients in the mean value calculation, which then implies a slower adaptation to new material properties, or fewer than five quotients, which implies a faster adaptation to new material properties. It is suitable to use at least three quotients, since otherwise there is a risk of a deviating quotient, which, for instance, may depend on an occasional very hard piece of material upon that very starting-up, getting an undesirably large impact on the mean value. However, the number of quotients is suitably less than ten in order not to require too many starting-ups for the adaptation to new material conditions.

Data for different material fractions, and first gap widths associated thereto, may also be stored in the control device 11. When an operator are going change the material fraction which should be crushed, he may choose the new material fraction in the control device and obtain a first gap width, which width has been stored from previous starting-ups with the same material fraction.

The invention claimed is:

1. Method for determining a start-up crushing gap width for a crushing operation in a gyratory crusher, the crusher comprising a crushing head fastened on a shaft and provided with first and second crushing shells arranged to form a crushing gap to receive material to be crushed, the width of the crushing gap being adjustable, and a driving device arranged to cause the crushing head to execute a gyratory pendulum movement, the method comprising the steps of:

A. activating the driving device to cause the crushing head to initiate a gyratory pendulum movement, with the crushing gap set at a first start-up width;

B. commencing a feed of material into the crushing gap to initiate crushing;

C. measuring a load on the crusher resulting from the crushing;

D. adjusting the width of the crushing gap to cause the load to approach a selected value, and obtaining a measure representative of the adjusted gap width;

E. calculating a subsequent start-up width in accordance with the obtained measure of step D; and F. setting the width of the crushing gap to correspond to the calculated subsequent start-up width of step E prior to repeating step A for a subsequent crushing operation;

wherein step B includes starting a countdown of a predetermined time period beginning with the start of the supply of material into the crushing gap; step D including determining whether the width adjustment has occurred within the predetermined time period; and step E being performed only if the width adjustment has occurred within the predetermined time period.

2. The method according to claim 1 wherein the predetermined time period is in the range of 3-30 seconds.

3. The method according to claim 1 wherein when a plurality of adjustments occur within the predetermined time period, step D comprises obtaining a measure that is representative of the crushing gap width following the first width adjustment that was made.

4. The method according to claim 3 wherein the predetermined time period is in the range of 3-30 seconds.

5. The method according to claim 1 wherein step E comprises determining a ratio between the adjusted width of step D and a constant-operation reference width, and calculating the subsequent start-up width in accordance with the ratio.

6. The method according to claim 5 further comprising performing steps A-F for a plurality of crushing operations, calculating a mean value of the ratios determined in step E for the plurality of crushing operations, and calculating the next subsequent start-up gap in accordance with the mean value.

7. The method according to claim 6 wherein the plurality of crushing operations is in the range of 3 to 10.

8. Method for determining a start-up crushing gap width for a crushing operation in a gyratory crusher, the crusher comprising a crushing head fastened on a shaft and provided with first and second crushing shells arranged to form a crushing gap to receive material to be crushed, the width of the crushing gap being adjustable, and a driving device arranged to cause the crushing head to execute a gyratory pendulum movement, the method comprising the steps of:

A. activating the driving device to cause the crushing head to initiate a gyratory pendulum movement, with the crushing gap set at a first start-up width;

B. commencing a feed of material into the crushing gap to initiate crushing, and starting a countdown of a predetermined time period at the start of the supply of material into the crushing gap;

C. measuring a load on the crusher resulting from the crushing,

D. adjusting the width of the crushing gap to cause the load to approach a selected value, and determining whether the width adjustment has occurred within the predetermined time period; and E. setting a gap width for a subsequent crushing operation to be the same as the first gap width, when the width adjustment of step D occurs after the predetermined time period.

9. Apparatus for determining a start-up crushing gap width for a crushing operation in a gyratory crusher which comprises a crushing head fastened on a shaft and provided with first and second crushing shells arranged to form a crushing gap to receive material to be crushed, the width of the crushing gap being adjustable, and a driving device arranged to cause the crushing head to execute a gyratory pendulum movement, the apparatus comprising:

activating means for activating the driving device to cause the crushing head to initiate a gyratory pendulum movement in a crushing operation, with the crushing gap set at a first start-up width;

measuring means for measuring a load on the crusher resulting from the crushing;

adjusting means for adjusting the gap width to cause the load to approach a selected value;

obtaining means for obtaining a measure representative of the adjusted gap width;

calculating means for calculating a subsequent start-up width for a subsequent crushing operation in accordance with the obtained measure; and a clock for counting down a predetermined time period beginning with the supply of material to the gap, wherein said calculating means is operable to calculate the subsequent start-up width only if the width adjustment is made within the predetermined time period.

* * * * *